US012606987B2

(12) United States Patent
Song et al.

(10) Patent No.: US 12,606,987 B2
(45) Date of Patent: Apr. 21, 2026

(54) EXCAVATOR, PRECISE CONTROL METHOD AND SYSTEM THEREFOR, VEHICLE TERMINAL AND STORAGE MEDIUM

(71) Applicant: XUZHOU XCMG EXCAVATOR MACHINERY CO., LTD, Xuzhou (CN)

(72) Inventors: Zhike Song, Xuzhou (CN); Jiawen Geng, Xuzhou (CN); Zecheng Xing, Xuzhou (CN); Dongdong Niu, Xuzhou (CN); Hongmin Wei, Xuzhou (CN); Dunkun Wang, Xuzhou (CN); Xutong Wang, Xuzhou (CN); Xin Ma, Xuzhou (CN); Bin Zhang, Xuzhou (CN); Xiangwei Lin, Xuzhou (CN); Xuefeng Yin, Xuzhou (CN)

(73) Assignee: XUZHOU XCMG EXCAVATOR MACHINERY CO., LTD, Xuzhou (CN)

( * ) Notice: Subject to any disclaimer, the term of this patent is extended or adjusted under 35 U.S.C. 154(b) by 307 days.

(21) Appl. No.: 18/292,833

(22) PCT Filed: May 7, 2022

(86) PCT No.: PCT/CN2022/091508

§ 371 (c)(1),
(2) Date: Jan. 26, 2024

(87) PCT Pub. No.: WO2023/005325

PCT Pub. Date: Feb. 2, 2023

(65) Prior Publication Data

US 2025/0003190 A1 Jan. 2, 2025

(30) Foreign Application Priority Data

Jul. 27, 2021 (CN) ..... 202110849323.8

(51) Int. Cl.
*E02F 9/20* (2006.01)

(52) U.S. Cl.
CPC ..... *E02F 9/205* (2013.01); *E02F 9/2004* (2013.01)

(58) Field of Classification Search
CPC . E02F 9/205; E02F 9/2004; E02F 9/20; E02F 9/2203; E02F 3/04
See application file for complete search history.

(56) References Cited

U.S. PATENT DOCUMENTS 5,361,211 A 11/1994 Lee et al.
10,458,095 B2 * 10/2019 Caillieret ..... E02F 3/43
(Continued)

FOREIGN PATENT DOCUMENTS

CN 102071717 B * 7/2012
CN 205839837 U 12/2016
(Continued)

OTHER PUBLICATIONS

Office Action Issued for Chinese Patent Application No. 202110849323.8, mailed Jun. 6, 2022, 10 pages.
(Continued)

*Primary Examiner* — Peter D Nolan
*Assistant Examiner* — Demetra R Smith-Stewart
(74) *Attorney, Agent, or Firm* — Sterne, Kessler, Goldstein & Fox P.L.L.C.

(57) ABSTRACT

The present disclosure relates to an excavator, a precise control method and system therefor, a vehicle terminal and a storage medium. The precise control method for the excavator comprises: presetting a plurality of work modes of the excavator, and an action rate and action coefficient corresponding to each working mode of the plurality of work modes; and performing work mode switching according to a handle input signal.

20 Claims, 6 Drawing Sheets

(56) References Cited

U.S. PATENT DOCUMENTS

| | | | | |
|---|---|---|---|---|
| 2023/0024622 | A1* | 1/2023 | Hoaby | E02F 3/436 |
| 2023/0025156 | A1* | 1/2023 | Cao | E02F 9/2203 |

FOREIGN PATENT DOCUMENTS

| | | | |
|---|---|---|---|
| CN | 106948406 | A | 7/2017 |
| CN | 109359524 | A | 2/2019 |
| CN | 110258709 | A | 9/2019 |
| CN | 110331756 | A | 10/2019 |
| CN | 111074964 | A | 4/2020 |
| CN | 112127414 | A | 12/2020 |
| CN | 113565162 | A | 10/2021 |
| WO | 9007613 | A1 | 7/1990 |

OTHER PUBLICATIONS

International Search Report for PCT/CN2022/091508, mailed Jul. 22, 2022, 4 pages.

* cited by examiner

First interface

Second interface

EXCAVATOR, PRECISE CONTROL METHOD AND SYSTEM THEREFOR, VEHICLE TERMINAL AND STORAGE MEDIUM

CROSS-REFERENCE TO RELATED APPLICATIONS

The present disclosure is a U.S. National Stage Application under 35 U.S.C. § 371 of International Patent Application No. PCT/CN2022/091508, filed on May 7, 2022, which is based on and claims priority of Chinese application for invention No. CN202110849323.8, filed on Jul. 27, 2021, the disclosure of both of which are hereby incorporated into this disclosure by reference in its entirety.

TECHNICAL FIELD

The present disclosure relates to the field of excavator control, in particular to an excavator and precise control method and system thereof, a vehicle terminal and a storage medium.

BACKGROUND

Currently, unmanned remote-controlled excavators are playing an increasingly important role in hazardous operating scenarios. In Related technologies, the problems of remote operation comprise that the remote view is not as accurate as the human eyes in on-site recognition, and the video delay can cause insufficient accuracy in remote operation. In the case of fine construction, the instability of the electronically controlled hydraulic system can affect the construction accuracy and create potential safety hazards.

SUMMARY

According to one aspect of the present disclosure, a precise control method for an excavator is provided. The precise control method for an excavator comprising: presetting a plurality of work modes of the excavator, and an action speed and action coefficients corresponding to each work mode of the plurality of work modes; and performing work mode switching according to a handle input signal.

In some embodiments of the present disclosure, the handle input signal is a button command signal of an electric control handle.

In some embodiments of the present disclosure, the performing work mode switching according to a handle input signal comprises: determining whether it is required to perform the work mode switching based on the button command signal of the electric control handle; and performing the work mode switching and retrieving an action speed and action coefficients corresponding to a switched work mode, in a case where it is determined that it is required to perform the work mode switching.

In some embodiments of the present disclosure, the precise control method of an excavator further comprises: receiving an opening signal from an electric control handle or an electric control pedal; distributing currents to determine an execution current for each action of the excavator, according to the opening signal of the electric control handle or the electric control pedal, and the switched work mode; and outputting a current by pressure and action judgement to drive an electromagnetic valve, to achieve precise action of the excavator, according to the execution current of each action of the excavator.

In some embodiments of the present disclosure, the distributing currents to determine an execution current for each action of the excavator, according to the opening signal of the electric control handle or the electric control pedal, and the switched work mode comprises: reading a switched work mode state, and collecting the opening signal from the electric control handle or the electric control pedal; determining a parameter group for the switched work mode based on the opening signal of the electric control handle or the electric control pedal, wherein the parameter group represents correspondence between opening signals and corresponding currents; and determining an execution current of each excavator action through an interpolation operation, according to the parameter group for the switched work mode.

In some embodiments of the present disclosure, the electric control handle and the electric control pedal are provided at a remote control terminal.

In some embodiments of the present disclosure, the handle input signal is a button command signal of the electric control handle.

In some embodiments of the present disclosure, the performing work mode switching according to a handle input signal comprises: obtaining a current work mode state and performing mode initialization; receiving the button command signal from the electric control handle; determining whether a handle button condition is satisfied, wherein the handle button condition is that a current state of the handle button is pressed and a previous cycle state of the handle button is unpressed; and performing the work mode switching, in a case where the handle button condition is satisfied.

In some embodiments of the present disclosure, the performing mode initialization comprises: setting the current state of the handle button to be unpressed, and the previous cycle state of the handle button state to be unpressed.

In some embodiments of the present disclosure, the performing the work mode switching comprises: determining whether a current mode parameter is greater than a predetermined threshold, wherein the predetermined threshold is greater than or equal to a preset number of the work modes; setting the current mode parameter to 1 and switching to a default mode of the excavator, in a case where the current mode parameter is greater than the predetermined threshold; and increasing the current mode parameter by 1 and executing a preset work mode of the excavator corresponding to a new current mode parameter increased from the current mode parameter by 1, in a case where the current mode parameter is not greater than the predetermined threshold.

According to another aspect of the present disclosure, a vehicle terminal is provided. The vehicle terminal comprises: a work mode setting module configured to preset a plurality of work modes of an excavator, and an action speed and action coefficients corresponding to each work mode of the plurality of work modes; and a work mode switching module configured to perform work mode switching according to a handle input signal.

In some embodiments of the present disclosure, the vehicle terminal is configured to perform operations of the precise control method of an excavator as described in any one of the above embodiments.

According to another aspect of the present disclosure, a vehicle terminal is provided. The vehicle terminal comprises: a memory configured to store instructions; and a processor configured to execute the instructions, so that the vehicle terminal performs the precise control method for an excavator as described in any of the above embodiments.

According to a further aspect of the present disclosure, a precise control system for an excavator is provided. The precise control system for an excavator comprises a vehicle terminal as described in any one of the above embodiments.

In some embodiments of the present disclosure, the precise control system for an excavator further comprises: a remote control terminal configured to input a control signal of at least one of an electric control handle and an electric control pedal to the vehicle terminal.

According to a further aspect of the present disclosure, an excavator is provided. The excavator comprises a vehicle terminal as described in any one of the above embodiments.

According to a further aspect of the present disclosure, a non-transient computer-readable storage medium is provided. The non-transient computer-readable storage medium stores computer program instructions which, when executed by a processor, implement the precise control method for an excavator according to any one of the above embodiments.

BRIEF DESCRIPTION OF THE DRAWINGS

In order to more clearly explain the embodiments of the present disclosure or the technical solutions in the prior art, a brief introduction will be given below for the drawings required to be used in the description of the embodiments or the prior art. It is obvious that, the drawings illustrated as follows are merely some of the embodiments of the present disclosure. For a person skilled in the art, he or she may also acquire other drawings according to such drawings on the premise that no inventive effort is involved.

DETAILED DESCRIPTION

Figure 1:
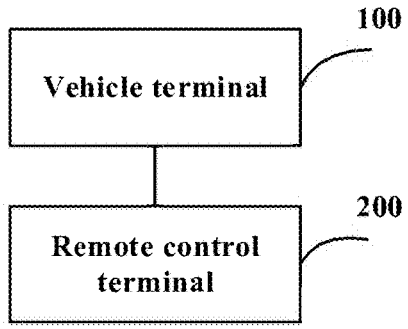
FIG. 1 is a schematic diagram of a precise control system for an excavator according to some embodiments of the present disclosure.

Below, a clear and complete description will be given for the technical solution of embodiments of the present disclosure with reference to the figures of the embodiments. Obviously, merely some embodiments of the present disclosure, rather than all embodiments thereof, are given herein. The following description of at least one exemplary embodiment is in fact merely illustrative and is in no way intended as a limitation to the invention, its application or use. All other embodiments acquired by those of ordinary skill in the art based on the embodiments of the present disclosure without creative efforts shall fall within the protection scope of the present disclosure.

Unless otherwise specified, the relative arrangement, numerical expressions and values of the components and steps set forth in these examples do not limit the scope of the invention.

At the same time, it should be understood that, for ease of description, the dimensions of the various parts shown in the drawings are not drawn to actual proportions.

Techniques, methods, and apparatus known to those of ordinary skill in the relevant art may not be discussed in detail, but where appropriate, these techniques, methods, and apparatuses should be considered as part of the specification.

Of all the examples shown and discussed herein, any specific value should be construed as merely illustrative and not as a limitation. Thus, other examples of exemplary embodiments may have different values.

Notice that, similar reference numerals and letters are denoted by the like in the accompanying drawings, and therefore, once an item is defined in a drawing, there is no need for further discussion in the accompanying drawings.

The inventor found through research that the accuracy of remote control operations in related technologies is fundamentally constrained by the ability to improve video clarity and reduce latency. The single control mode of related technologies cannot satisfy the high-precision operation requirements for precise control of micro-operations.

In view of at least one of the above technical issues, the present disclosure provides an excavator and precise control method and system thereof, a vehicle terminal, and a storage medium, which can achieve One-key switching of working modes through the handle button.

FIG. 1 is a schematic diagram of a precise control system for an excavator according to some embodiments of the present disclosure. As shown in FIG. 1, the precise control system for an excavator of this disclosure comprises a vehicle terminal 100 and a remote control terminal 200.

The remote control terminal 200 is configured to input a control signal of at least one of an electric control handle and an electric control pedal to the vehicle terminal.

The vehicle terminal 100 is configured to preset a plurality of work modes of the excavator, and an action speed and action coefficients corresponding to each work mode of the plurality of work modes; and perform work mode switching according to a handle input signal.

Figure 2:
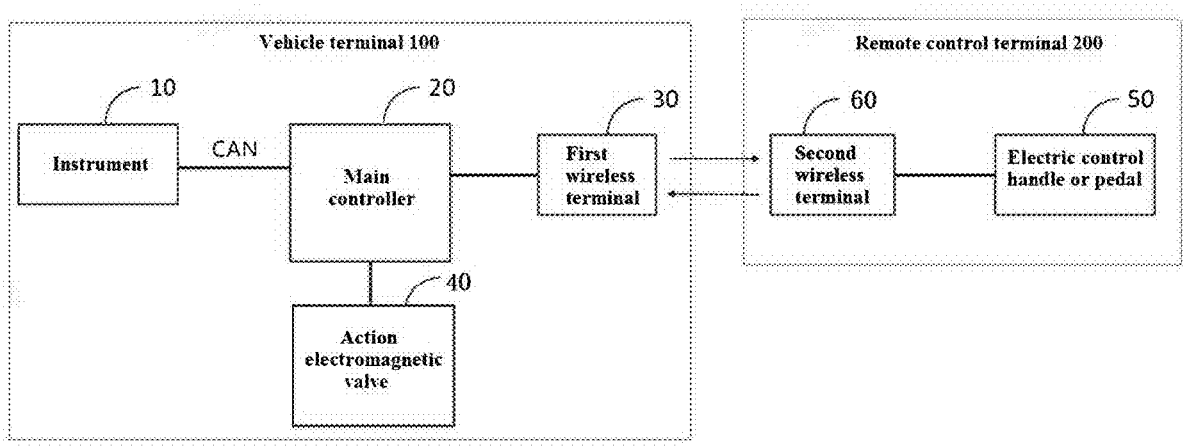
FIG. 2 is a schematic diagram of a precise control system for an excavator according to other embodiments of the present disclosure.

FIG. 2 is a schematic diagram of a precise control system for an excavator according to other embodiments of the present disclosure. As shown in FIG. 2, the vehicle terminal 100 comprises an instrument 10, a main controller 20, a first wireless terminal 30 and an action electromagnetic valve 40.

The instrument 10 is a system input module for activating a fine mode function via a setting interface, and for providing a custom setting interface.

The main controller 20 is a core control unit of the system, which is used to receive instrument setting information and electric control handle or pedal information, and perform manipulation signal processing, fine mode switching, action stability control and electromagnetic valve driving through a core computing module.

The first wireless terminal 30 is a communication device used for data transmission between the remote control terminal and the vehicle terminal.

The action electromagnetic valve 40 is an actuator element used to implement PWM (Pulse Width Modulation)

driving by the main controller 20, establish a pilot pressure, and drive the main valve core to act.

In some embodiments of the present disclosure, the action electromagnetic valve 40 may be a 12-port action electromagnetic valve.

In some embodiments of the present disclosure, as shown in FIG. 2, the remote control terminal 200 may comprise an electric control handle 50, an electric control pedal 50 and a second wireless terminal 60, wherein:

The second wireless terminal 60 is a communication device used for data transmission between the remote control terminal and the vehicle terminal.

The electric control handle and the electric control pedal 50 are control signal input components used to send handle and pedal position signals via a CAN (Controller Area Network) bus and to achieve quick mode switching via a handle button.

This disclosure allows work mode switching via a single handle button, which can help the operator to control the entire machine and quickly switch to a fine control mode.

Figure 3:
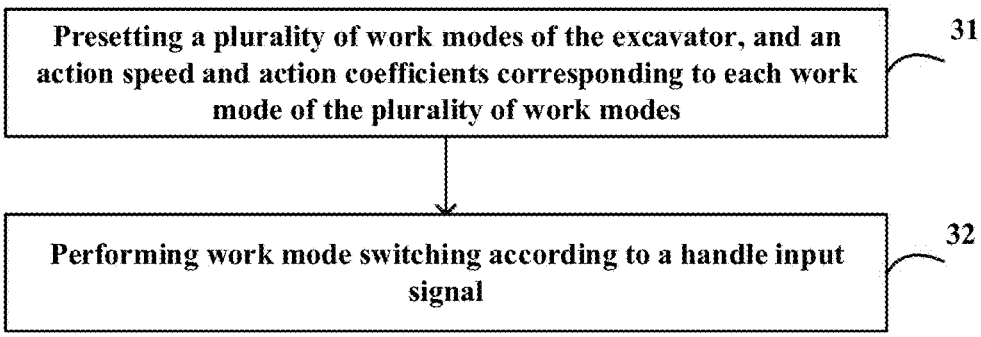
FIG. 3 is a schematic diagram of a precise control method for an excavator according to still other embodiments of the present disclosure.

FIG. 3 is a schematic diagram of a precise control method for an excavator according to still other embodiments of the present disclosure. Preferably, the method of this embodiment can be performed by the precise control system for an excavator or the vehicle terminal of the present disclosure. This method may comprise at least one of steps 31 and 32.

In step 31, a plurality of work modes of an excavator, an action speed and action coefficients corresponding to each work mode of the plurality of work modes are set in advance.

Figure 4:
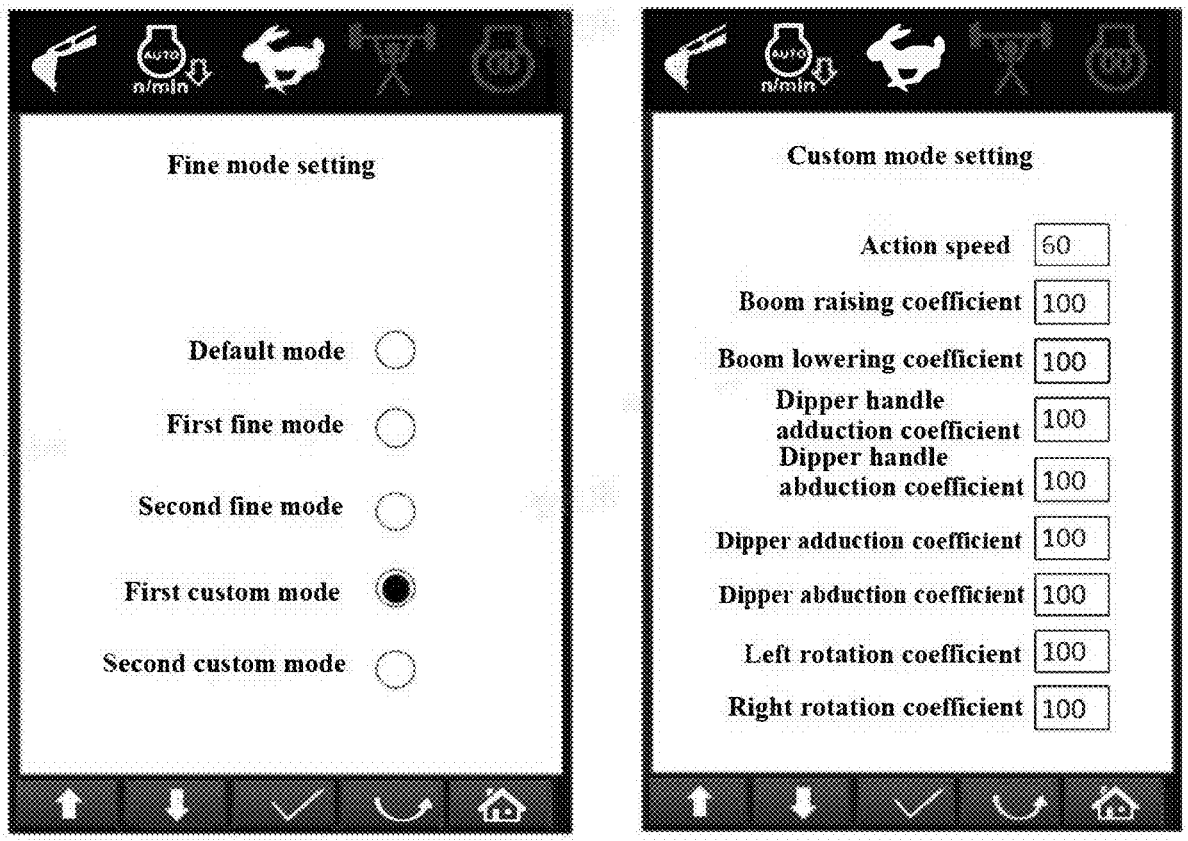
FIG. 4 is a schematic diagram of a custom mode instrument setting interface in some embodiments of the present disclosure.

FIG. 4 is a schematic diagram of custom mode instrument setting interfaces in some embodiments of the present disclosure. As shown in FIG. 4, different control modes can be selected through a first interface. A second interface is a parameter setting interface for a first custom mode or a second custom mode. By setting the coefficients of different actions, operational requirements of different operators for excavator actions can be met.

In some embodiments of the present disclosure, as shown in FIG. 4, fine modes that can be selected in the first interface comprise a default mode, a first fine mode, a second fine mode, the first custom mode and the second custom mode.

In some embodiments of the present disclosure, as shown in FIG. 4, the custom mode settings in the second interface comprise the settings of parameters such as action speed, boom raising coefficient, boom lowering coefficient, dipper handle adduction coefficient, dipper handle abduction coefficient, dipper adduction coefficient, dipper abduction coefficient, left rotation coefficient, and right rotation coefficient.

In step 32, the work mode switching is performed based on a handle input signal.

In some embodiments of the present disclosure, the handle input signal is a button command signal of an electric control handle.

In some embodiments of the present disclosure, the step 32 may comprise at least one of steps 321 and 322.

In step 321, it is determined whether it is required to perform the work mode switching, based on the button command signal of the electric control handle.

In step 322, the work mode switching is performed, an action speed and action coefficients are retrieved corresponding to a switched work mode, in a case where it is determined that it is required to perform the work mode switching.

In some embodiments of the present disclosure, the step 32 may comprise: obtaining a current work mode state and performing mode initialization; receiving the button command signal from the electric control handle; determining whether a handle button condition is satisfied, wherein the handle button condition is that a current state of the handle button is pressed and a previous cycle state of the handle button is unpressed; and performing the work mode switching, in a case where the handle button condition is satisfied.

In some embodiments of the present disclosure, the step of performing mode initialization comprises: setting the current state of the handle button to be unpressed, and the previous cycle state of the handle button state to be unpressed.

In some embodiments of the present disclosure, the step of performing the work mode switching comprises: determining whether a current mode parameter mode_k is greater than a predetermined threshold, wherein the predetermined threshold is greater than or equal to a preset number of the work modes; setting the current mode parameter to 1 and switching to a default mode of the excavator, in a case where the current mode parameter is greater than the predetermined threshold; and increasing the current mode parameter by 1, and executing a preset work mode of the excavator corresponding to a new current mode parameter increased from the current mode parameter by 1, in a case where the current mode parameter is not greater than the predetermined threshold.

In some embodiments of the present disclosure, the precise control method of an excavator further comprises: receiving an opening signal from an electric control handle or an electric control pedal; distributing currents to determine an execution current for each action of the excavator, according to the opening signal of the electric control handle or the electric control pedal, and the switched work mode; and outputting a current by pressure and action judgement to drive an electromagnetic valve, to achieve precise action of the excavator, according to the execution current of each action of the excavator.

In some embodiments of the present disclosure, the step of distributing currents to determine an execution current for each action of the excavator, according to the opening signal of the electric control handle or the electric control pedal, and the switched work mode comprises: reading a switched work mode state, and collecting the opening signal from the electric control handle or the electric control pedal; determining a parameter group for the switched work mode based on the opening signal of the electric control handle or the electric control pedal, wherein the parameter group represents correspondence between opening signals and corresponding currents; and determining an execution current of each excavator through action an interpolation operation, according to the parameter group for the switched work mode.

In some embodiments of the present disclosure, the electric control handle and the electric control pedal are provided at a remote control terminal.

In the above embodiment of the present disclosure, a control strategy is developed to customize mode parameters through an instrument, to provide more comfortable and widely applicable work modes for the operator. By setting the action speed and various action coefficients, the internal program automatically adapts the current for a composite action, which can improve the accuracy and efficiency of the operation to meet the operator's needs in different operating conditions.

Figure 5:
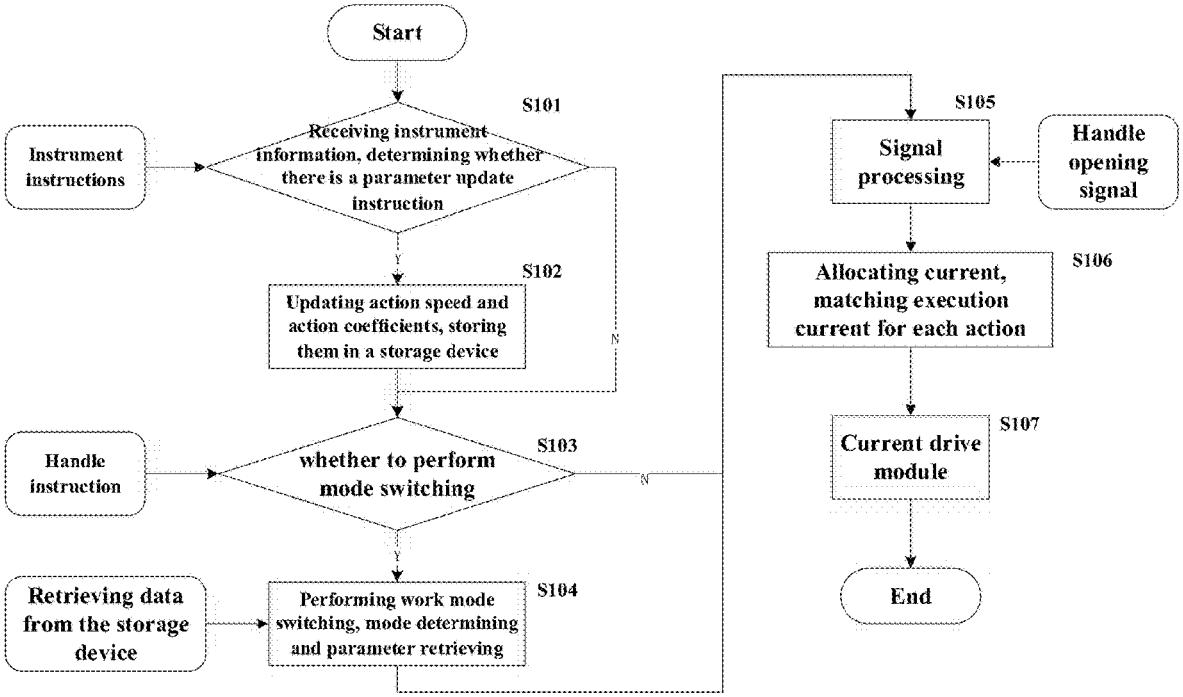
FIG. 5 is a schematic diagram of a precise control method for an excavator according to still other embodiments of the present disclosure.

FIG. 5 is a schematic diagram of a precise control method for an excavator according to still other embodiments of the present disclosure. Preferably, the method of this embodiment can be performed by the precise control system for an excavator or the vehicle terminal of the present disclosure. This method may comprise at least one of steps 101 to S107.

In step S101, the main controller 20 receives instructions from the instrument 10 and determines whether there is a parameter update instruction. If there is a parameter update instruction, the method proceeds to step S102, otherwise the method proceeds to step S103.

In step S102, the main controller 20 receives an action speed and action coefficients sent by the instrument 10 and stores them in a storage device for retrieval by the fine mode control system, and then the method proceeds to step S103.

In step S103, the main controller 20 receives a button command signal of the electric control handle 50 through the wireless terminal 30, and determines whether to perform mode switching; in step S103, a control strategy is provided to quickly switch between work modes by touching a button on the handle.

In step S104, work mode switching is performed by retrieving the parameters from the storage device.

In step S105, the main controller 20 receives the opening signal of the electric control handle or the electric control pedal 50 through the wireless terminal 30, and processes the operation signal; in step S105, a fine mode-based operation signal processing method is provided.

In step S106, the main controller 20 allocates current based on the work mode; in step S106, a current allocation control method is provided.

In step S107, with the execution current of each action as the input, a current drive module outputs current by pressure and action judgement to drive an electromagnetic valve 40, so as to achieve precise action of the excavator.

Figure 6:
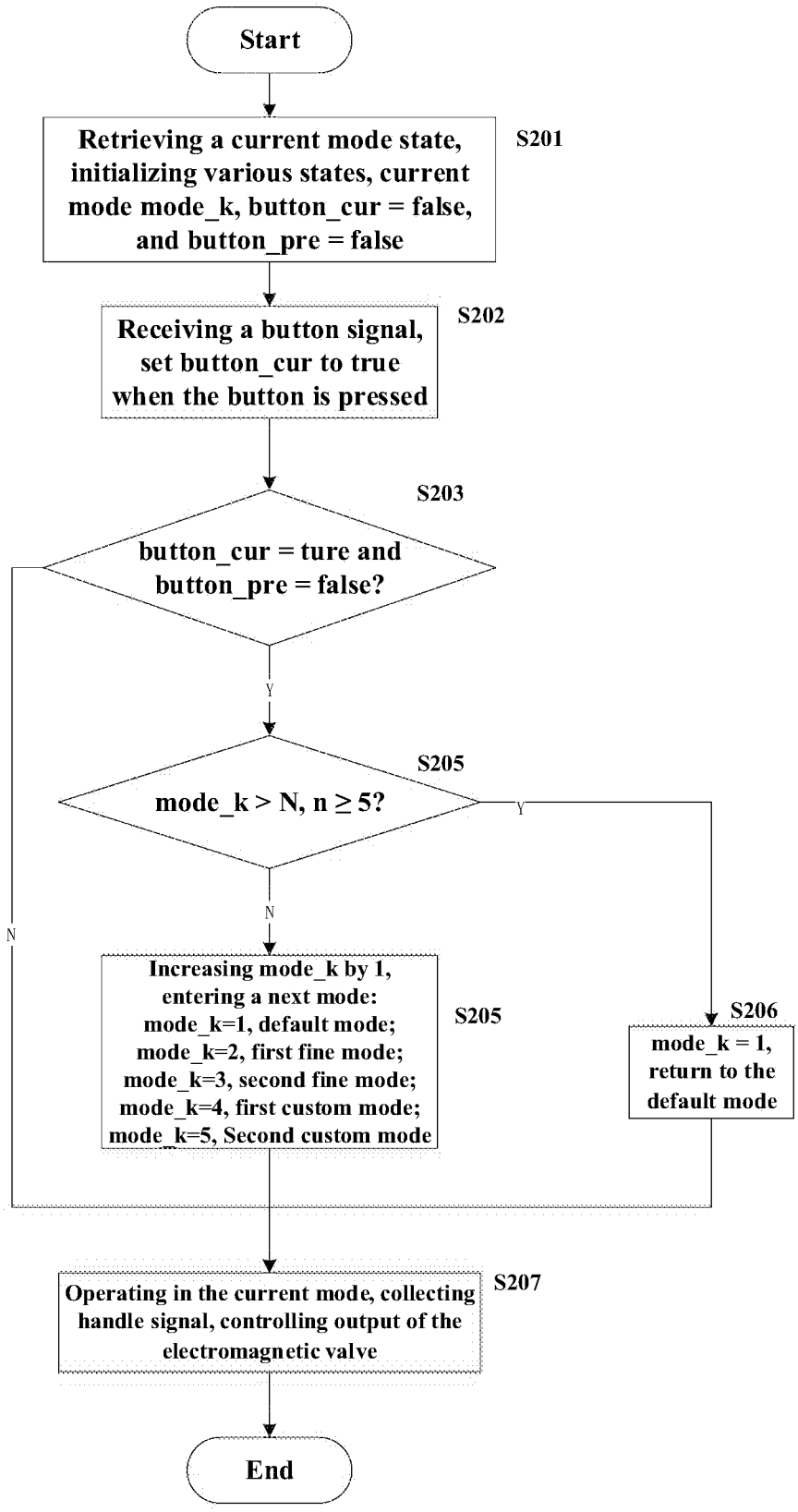
FIG. 6 is a schematic diagram of a control strategy for quick work mode switching by touching a handle button according to some embodiments of the present disclosure.

FIG. 6 is a schematic diagram of a control strategy for quick work mode switching by touching a handle button according to some embodiments of the present disclosure. As shown in FIG. 6, the control method for quick work mode switching by touching a handle button (such as step S103 in the embodiment of FIG. 5) can comprise at least one of steps S201 to S207.

In step S201, the main controller 20 runs a program to retrieve a current mode state from the storage device, and initialize a current mode parameter mode_k based on the current mode, a current state button_cur of the handle button is false, and a previous cycle state button_pre of the handle button is false.

In step S202, the main controller 20 receives a button signal from the electric control handle 50, and sets button_cur to true in a case where it is determined a button pressed signal is received.

In step S203, it is determined whether button_cur=ture and button_pre=false; if so, the method proceeds to step S204, otherwise, the method proceeds to step S207.

Step S204, it is determined whether mode_k>N, n≥5. If not, the method proceeds to step S205; otherwise, the method proceeds to step S206.

In step S205, mode_k is increased by 1, and a mode is determined based on mode_k:

mode_k=1, switching to the default mode;
mode_k=2, switching to the first fine mode;
mode_k=3, switching to the second fine mode;
mode_k=4, switching to the first custom mode;
mode_k=5, switching to the second custom mode;
. . .

In step S206, mode_k is set to 1, the system returns to the default mode.

In step S207, the current mode mode_k is performed.

The above embodiment of the present disclosure can perform cyclic work mode switching by determining the state switching of the handle button in the program, thereby achieving fast work mode switching with a single button.

Figure 7:
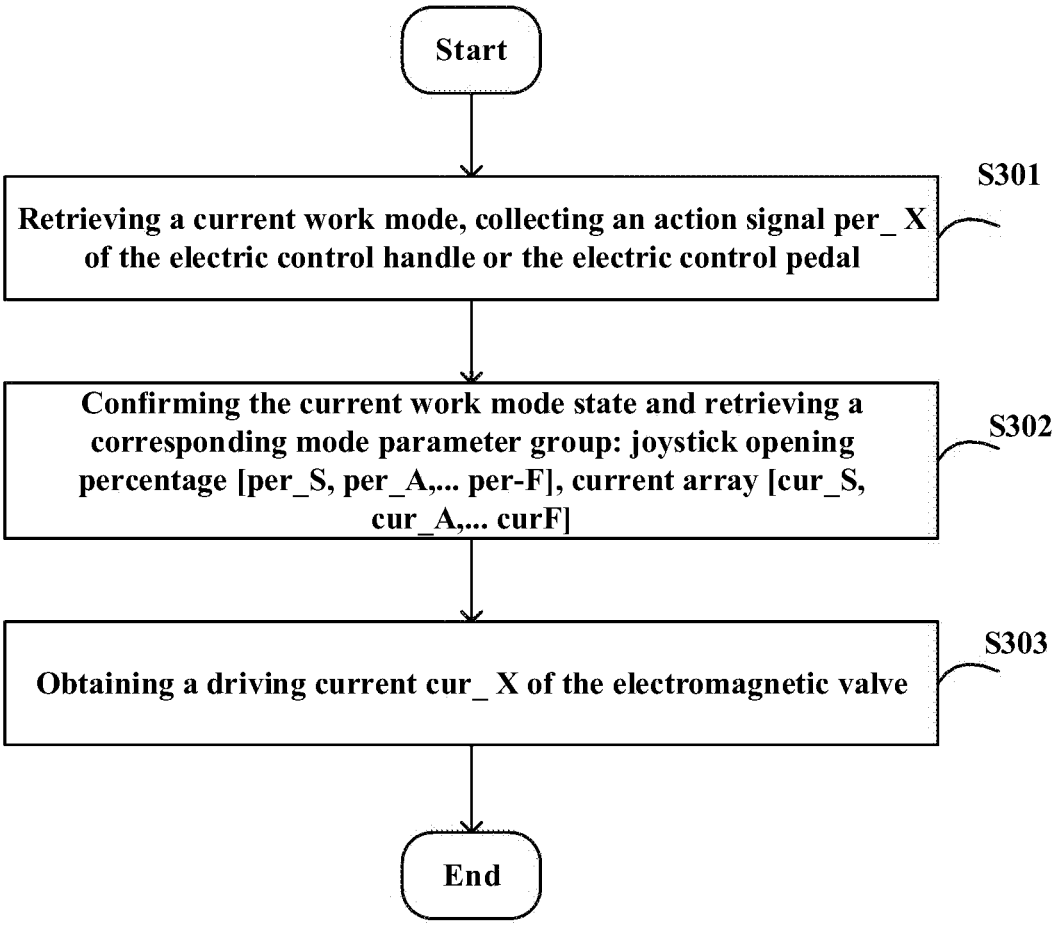
FIG. 7 is a schematic diagram of a fine mode-based handle signal processing method according to some embodiments of the present disclosure.

FIG. 7 is a schematic diagram of a fine mode-based handle signal processing method according to some embodiments of the present disclosure. As shown in FIG. 7, the fine mode-based handle signal processing method (such as step S105 in the embodiment of FIG. 5) can comprise at least one of steps S301 to S303.

In step S301, a current work mode state is retrieved, and an action signal per_X of the electric control handle or the electric control pedal is collected.

In step S302, the current work mode state is confirmed and a corresponding mode parameter group is retrieved.

For example, mode_k=1, a default mode, joystick opening percentage [per_S1, per_A1, . . . per-F1], current array [cur_S2, cur_A2, . . . curF2]; mode_k=2, a first fine mode, joystick opening percentage [per_S2, per_A2, . . . perF2], current array [cur_S2, cur_A2, . . . curF2]; mode_k=3, a second fine mode, joystick opening percentage [per_S3, per_A3, . . . perF3], current array [cur_S3, cur_A3, . . . curF3]; mode_k=4, a first custom mode, joystick opening percentage [per_S4, per_A4, . . . per-F4], current array [cur_S4, cur_A4, . . . curF4]; mode_k=5, a second custom mode, joystick opening percentage [per_S5, per_A5, . . . perF5], current array [cur_S5, cur_A5, . . . curF5].

In step S303, a driving current cur_X of the electromagnetic valve is calculated by interpolation.

Based on the precise excavator control method provided in the above embodiment of this disclosure, a technical method for control mode switching via a single handle button is provided, which can help the operator to control the whole machine to quickly switch to a fine control mode and achieve precise control of micro-operations. The above embodiment can reduce operational errors and jitter by processing, amplifying and outputting a remote operating handle signal. The above embodiment provides a control method that can customize the action speed through an instrument, and save user-defined parameters. In addition, the above embodiment provides a control method that can switch modes with a single handle button, making it easier for users to quickly switch modes.

The precise control method for an excavator provided in the above embodiment of this disclosure comprises a user defined action speed control method and single button switching.

Figure 8:
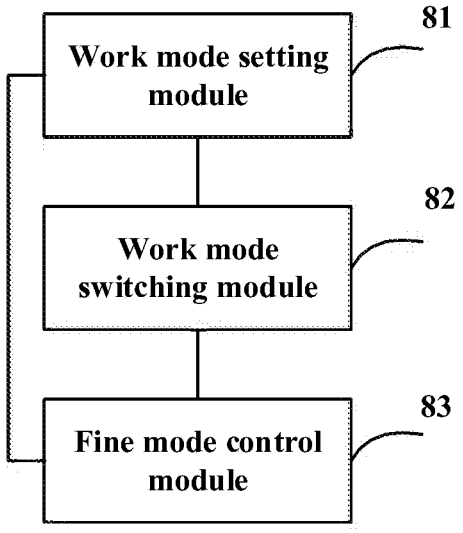
FIG. 8 is a schematic diagram of a vehicle terminal according to some embodiments of the present disclosure.

FIG. 8 is a schematic diagram of a vehicle terminal according to some embodiments of the present disclosure. As shown in FIG. 8, the vehicle terminal of the present disclosure can comprise a work mode setting module 81 and a work mode switching module 82.

The work mode setting module 81 is configured to preset a plurality of work modes of an excavator, and an action speed and action coefficients corresponding to each work mode of the plurality of work modes.

The work mode switching module 82 is configured to perform work mode switching according to a handle input signal.

In some embodiments of the present disclosure, the handle input signal is a button command signal of an electric control handle.

In some embodiments of the present disclosure, the work mode switching module 82 can be used to determine whether it is required to perform the work mode switching based on the button command signal of the electric control handle; and perform the work mode switching and retrieving an action speed and action coefficients corresponding to a switched work mode, in a case where it is determined that it is required to perform the work mode switching.

In some embodiments of the present disclosure, the work mode switching module 82 can be used to obtain a current work mode state and perform mode initialization; receive the button command signal from the electric control handle; determine whether a handle button condition is satisfied, wherein the handle button condition is that a current state of the handle button is pressed and a previous cycle state of the handle button is unpressed; and perform the work mode switching, in a case where the handle button condition is satisfied.

In some embodiments of the present disclosure, the work mode switching module 82 is used for, in mode initialization, setting the current state of the handle button to be unpressed, and the previous cycle state of the handle button state to be unpressed.

In some embodiments of the present disclosure, the work mode switching module 82 is used for, in work mode switching, determining whether a current mode parameter is greater than a predetermined threshold, wherein the predetermined threshold is greater than or equal to a preset number of the work modes; setting the current mode parameter to 1 and switching to a default mode of the excavator, in a case where the current mode parameter is greater than the predetermined threshold; and increasing the current mode parameter by 1, and executing a preset work mode of the excavator corresponding to a new current mode parameter increased from the current mode parameter by 1, in a case where the current mode parameter is not greater than the predetermined threshold.

In some embodiments of the present disclosure, as shown in FIG. 8, the vehicle terminal of the present disclosure may comprise a fine mode control module 83.

The fine mode control module 83 is used to receive an opening signal from an electric control handle or an electric control pedal; distribute currents to determine an execution current for each action of the excavator, according to the opening signal of the electric control handle or the electric control pedal, and the switched work mode; and output a current by pressure and action judgement to drive an electromagnetic valve, to achieve precise action of the excavator, according to the execution current of each action of the excavator.

In some embodiments of the present disclosure, the fine mode control module 83 is used to read a switched work mode state, and collect the opening signal from the electric control handle or the electric control pedal; determine a parameter group for the switched work mode based on the opening signal of the electric control handle or the electric control pedal, wherein the parameter group represents correspondence between opening signals and corresponding currents; and determine an execution current of each excavator action through an interpolation operation, according to the parameter group for the switched work mode.

In some embodiments of the present disclosure, the electric control handle and the electric control pedal are provided at a remote control terminal.

In some embodiments of the present disclosure, the handle input signal is a button command signal of an electric control handle.

In some embodiments of the present disclosure, the vehicle terminal can be used to perform operations of the precise control method of an excavator as described in any of the above embodiments (any one of the embodiments shown in FIGS. 3 to 7).

The above embodiment of the present disclosure can perform cyclic work mode switching by determining the state switching of the handle button in the program, thereby achieving fast work mode switching with a single button.

Figure 9:
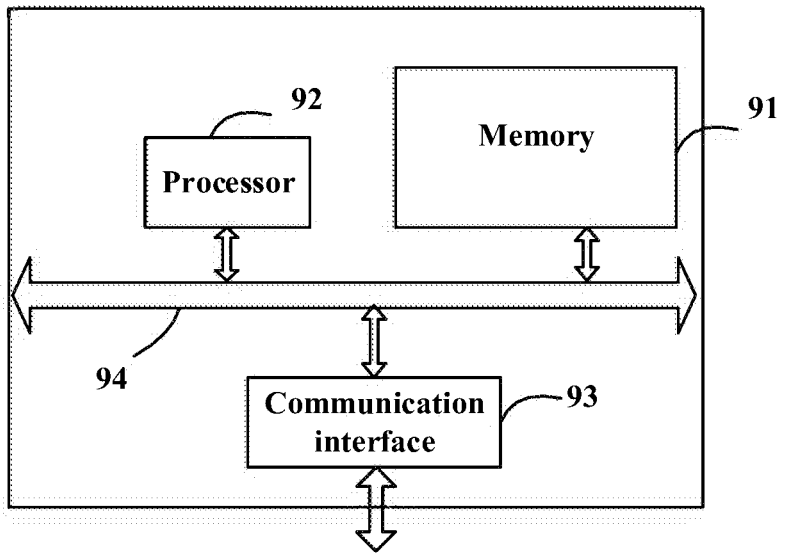
FIG. 9 is a schematic structural diagram of a vehicle terminal according to some embodiments of the present disclosure.

FIG. 9 is a schematic structural diagram of a vehicle terminal according to some embodiments of the present disclosure. As shown in FIG. 9, the vehicle terminal comprises a memory 91 and a processor 92.

The memory 91 is used to store instructions. The processor 92 is coupled to the memory 91, and is configured to, based on instructions stored in the memory, carry out the precise excavator control method provided in any one of the above embodiments (any one of the embodiments shown in FIGS. 3 to 7).

As shown in FIG. 9, the vehicle terminal further comprises a communication interface 93 for performing information interaction with other devices. In addition, the vehicle terminal further comprises a bus 94. The processor 92, the communication interface 93, and the memory 91 perform communication with each other through the bus 94.

The memory 91 may comprise a high speed RAM memory, and may also comprise a non-volatile memory such as at least one disk storage device. The memory 91 may also be a memory array. The memory 91 may also be partitioned into blocks, which may be combined into virtual volumes according to a certain rule.

In addition, the processor 92 may be a central processing unit (CPU), or may be an Application Specific Integrated Circuit (ASIC) or one or more integrated circuits configured to implement the embodiments of the present disclosure.

In the above embodiment of the present disclosure, a control strategy is developed to customize mode parameters through an instrument, to provide more comfortable and widely applicable work modes for the operator. By setting the action speed and various action coefficients, the internal program automatically adapts the current for a composite action, which can improve the accuracy and efficiency of the operation to meet the operator's needs in different operating conditions.

The above embodiment of this disclosure can achieve differentiation of operation precision in different modes by processing operation signals according to different work modes, for example, by amplifying or diminishing the operation signals, thereby improving operation sensitivity and stability.

According to a further aspect of the present disclosure, there is provided an excavator, comprising a vehicle terminal as described in any of the above embodiments (any one of the embodiments shown in FIG. 8 or 9).

According to a further aspect of the present disclosure, there is provided a non-transient computer-readable storage medium stored thereon computer instructions that, when executed by a processor, implement the precise control method for an excavator according to any one of the above embodiments (any one of the embodiments shown in FIGS. 3 to 7).

Based on the non-transient computer-readable storage medium provided in the above embodiment of this disclosure, a fast, flexible and customizable fine mode control method is provided, which can help the operator to reduce the visual impact and enable more fine control of the excavator to perform fine actions. In addition, customizable control modes are provided. By setting different action speeds and coefficients, precise control and wider applicability are achieved, improving efficiency in fine operations.

One skilled in the art should understand that, the embodiments of the present disclosure may be provided as a method, an apparatus, or a computer program product. Therefore, embodiments of the present disclosure can take the form of an entirely hardware embodiment, an entirely software embodiment or an embodiment containing both hardware and software elements. Moreover, the present disclosure may take the form of a computer program product embodied on one or more computer-usable non-transient storage media (including but not limited to disk storage, CD-ROM, optical storage device, etc.) having computer-usable program code embodied therein.

The present disclosure is described with reference to flowcharts and/or block diagrams of methods, apparatuses (systems) and computer program products according to embodiments of the present disclosure. It should be understood that each process and/or block in the flowcharts and/or block diagrams, and combinations of the processes and/or blocks in the flowcharts and/or block diagrams may be implemented by computer program instructions. The computer program instructions may be provided to a processor of a general purpose computer, a special purpose computer, an embedded processor, or other programmable data processing apparatus to generate a machine such that the instructions executed by a processor of a computer or other programmable data processing apparatus to generate means implementing the functions specified in one or more flows of the flowcharts and/or one or more blocks of the block diagrams.

The computer program instructions may also be stored in a computer readable storage device capable of directing a computer or other programmable data processing apparatus to operate in a specific manner such that the instructions stored in the computer readable storage device produce an article of manufacture including instruction means implementing the functions specified in one or more flows of the flowcharts and/or one or more blocks of the block diagrams.

These computer program instructions can also be loaded onto a computer or other programmable device to perform a series of operation steps on the computer or other programmable device to generate a computer-implemented process such that the instructions executed on the computer or other programmable device provide steps implementing the functions specified in one or more flows of the flowcharts and/or one or more blocks of the block diagrams.

The vehicle terminal described above may be implemented as a general-purpose processor for performing the functions described in this application, Programmable logic controller (PLC), digital signal processor (DSP), application specific integrated circuit (ASIC), field programmable gate array (FPGA) or other programmable logic devices, discrete gates or transistor logic devices, discrete hardware components or any appropriate combination thereof.

Heretofore, the present disclosure has been described in detail. In order to avoid obscuring the concepts of the present disclosure, some details known in the art are not described. Based on the above description, those skilled in the art can understand how to implement the technical solutions disclosed herein.

A person skilled in the art can understand that all or part of the steps for carrying out the method in the above embodiments can be completed by hardware or a program instructing the related hardware, wherein the program can be stored in a non-transient computer readable storage medium. The storage medium may be a read-only memory (ROM), a magnetic disk or a compact disk (CD).

The above description of this invention is given for illustration and description, but is not exhaustive and is not intended to limit the present invention to the form disclosed herein. Various modifications and variations are apparent for a person of ordinary skill in the art. Embodiments are selected and described for a better illustration of the principle and practical application of this invention, so that those skilled in the art can understand this invention and envisage various embodiments with various modifications suited to specific usages.

What is claimed is:

1. A precise control method for an excavator, comprising:

presetting a plurality of work modes of the excavator, and an action speed and action coefficients corresponding to each work mode of the plurality of work modes; and performing work mode switching according to a handle input signal.

2. The precise control method for an excavator according to claim 1, wherein the handle input signal is a button command signal of an electric control handle, and the performing work mode switching according to a handle input signal comprises:

determining whether it is required to perform the work mode switching based on the button command signal of the electric control handle; and performing the work mode switching and retrieving an action speed and action coefficients corresponding to a switched work mode, in a case where it is determined that it is required to perform the work mode switching.

3. The precise control method for an excavator according to claim 1, further comprising:

receiving an opening signal from an electric control handle or an electric control pedal;

distributing currents to determine an execution current for each action of the excavator, according to the opening signal of the electric control handle or the electric control pedal, and the switched work mode; and outputting a current by pressure and action judgement to drive an electromagnetic valve, to achieve precise action of the excavator, according to the execution current of each action of the excavator.

4. The precise control method for an excavator according to claim 3, wherein the distributing currents to determine an execution current for each action of the excavator, according to the opening signal of the electric control handle or the electric control pedal, and the switched work mode comprises:

reading a switched work mode state, and collecting the opening signal from the electric control handle or the electric control pedal;

determining a parameter group for the switched work mode based on the opening signal of the electric control handle or the electric control pedal, wherein the parameter group represents correspondence between opening signals and corresponding currents; and determining an execution current of each excavator action through an interpolation operation, according to the parameter group for the switched work mode.

5. The precise control method for an excavator according to claim 3, wherein the electric control handle and the electric control pedal are provided at a remote control terminal.

6. The precise control method for an excavator according to claim 1, wherein the handle input signal is a button command signal of an electric control handle, and the performing work mode switching according to a handle input signal comprises:

obtaining a current work mode state and performing mode initialization;

receiving the button command signal from the electric control handle;

determining whether a handle button condition is satisfied, wherein the handle button condition is that a current state of the handle button is pressed and a previous cycle state of the handle button is unpressed; and performing the work mode switching, in a case where the handle button condition is satisfied.

7. The precise control method for an excavator according to claim 6, wherein the performing mode initialization comprises:

setting the current state of the handle button to be unpressed, and the previous cycle state of the handle button state to be unpressed.

8. The precise control method for an excavator according to claim 1, wherein the performing the work mode switching comprises:

determining whether a current mode parameter is greater than a predetermined threshold, wherein the predetermined threshold is greater than or equal to a preset number of the work modes;

setting the current mode parameter to 1 and switching to a default mode of the excavator, in a case where the current mode parameter is greater than the predetermined threshold; and increasing the current mode parameter by 1, and executing a preset work mode of the excavator corresponding to a new current mode parameter increased from the current mode parameter by 1, in a case where the current mode parameter is not greater than the predetermined threshold.

9. A vehicle terminal, comprising:

a work mode setting module configured to preset a plurality of work modes of an excavator, and an action speed and action coefficients corresponding to each work mode of the plurality of work modes; and a work mode switching module configured to perform work mode switching according to a handle input signal.

10. A vehicle terminal, comprising:

a memory configured to store instructions; and a processor configured to execute a method for performing the instructions comprising: presetting a plurality of work modes of the excavator, and an action speed and action coefficients corresponding to each work mode of the plurality of work modes; and performing work mode switching according to a handle input signal.

11. The vehicle terminal according to claim 10, wherein the handle input signal is a button command signal of an electric control handle, and the performing work mode switching according to a handle input signal comprises:

determining whether it is required to perform the work mode switching based on the button command signal of the electric control handle; and performing the work mode switching and retrieving an action speed and action coefficients corresponding to a switched work mode, in a case where it is determined that it is required to perform the work mode switching.

12. The vehicle terminal according to claim 10, wherein the method further comprises:

receiving an opening signal from an electric control handle or an electric control pedal;

distributing currents to determine an execution current for each action of the excavator, according to the opening signal of the electric control handle or the electric control pedal, and the switched work mode; and outputting a current by pressure and action judgement to drive an electromagnetic valve, to achieve precise action of the excavator, according to the execution current of each action of the excavator.

13. The vehicle terminal according to claim 12, wherein the distributing currents to determine an execution current for each action of the excavator, according to the opening signal of the electric control handle or the electric control pedal, and the switched work mode comprises:

reading a switched work mode state, and collecting the opening signal from the electric control handle or the electric control pedal;

determining a parameter group for the switched work mode based on the opening signal of the electric control handle or the electric control pedal, wherein the parameter group represents correspondence between opening signals and corresponding currents; and determining an execution current of each excavator action through an interpolation operation, according to the parameter group for the switched work mode.

14. The vehicle terminal according to claim 10, wherein the handle input signal is a button command signal of an electric control handle, and the performing work mode switching according to a handle input signal comprises:

obtaining a current work mode state and performing mode initialization;

receiving the button command signal from the electric control handle;

determining whether a handle button condition is satisfied, wherein the handle button condition is that a current state of the handle button is pressed and a previous cycle state of the handle button is unpressed; and performing the work mode switching, in a case where the handle button condition is satisfied.

15. A precise control system for an excavator, comprising the vehicle terminal according to claim 9.

16. The precise control system for an excavator according to claim 15, further comprising:

a remote control terminal configured to input a control signal of at least one of an electric control handle and an electric control pedal to the vehicle terminal.

17. An excavator, comprising the vehicle terminal according to claim 9.

18. A non-transient computer-readable storage medium stored thereon computer instructions that, when executed by a processor, implement the precise control method for an excavator according to claim 1.

19. A precise control system for an excavator, comprising the vehicle terminal according to claim 10.

20. An excavator, comprising the vehicle terminal according to claim 10.

* * * * *